United States Patent [19]

Kostelitz et al.

[11] Patent Number: 4,519,853

[45] Date of Patent: May 28, 1985

[54] METHOD OF CARBURIZING WORKPIECE

[75] Inventors: Michel Kostelitz, Versailles; Philippe Queille, Viroflay, both of France

[73] Assignee: L'Air Liquide, Societe Anonyme Pour L'Etude et L'Exploitation des Procedes Georges Claude, Paris, France

[21] Appl. No.: 496,934

[22] Filed: May 23, 1983

[30] Foreign Application Priority Data

May 28, 1982 [FR] France ..... 82 09328

[51] Int. Cl.[3] ..... C23C 11/10

[52] U.S. Cl. ..... 148/16.5

[58] Field of Search ..... 148/16.5

[56] References Cited

U.S. PATENT DOCUMENTS

| | | | |
|---|---|---|---|
| 26,935 | 8/1970 | Cullen | 148/16.5 |
| 2,955,062 | 10/1960 | Cullen | 148/16.5 |
| 3,128,323 | 4/1964 | Davis | 266/80 |
| 3,795,551 | 3/1974 | Swirnow | 148/16.5 |
| 3,891,474 | 6/1975 | Grange | 148/16.5 |
| 3,950,192 | 4/1976 | Golland et al. | 148/16.5 |
| 4,160,680 | 7/1979 | Novy et al. | 148/16.5 |
| 4,175,986 | 11/1979 | Ewalt et al. | 148/16.5 |
| 4,202,710 | 5/1980 | Naito et al. | 148/16.5 |
| 4,208,224 | 6/1980 | Girell | 148/16.5 |
| 4,306,918 | 12/1981 | Kaspersma et al. | 148/16.5 |
| 4,317,687 | 3/1982 | Kaspersma et al. | 148/16.5 |
| 4,322,255 | 3/1982 | Kostelitz | 148/16.5 |

FOREIGN PATENT DOCUMENTS

| | | | |
|---|---|---|---|
| 2417179 | 10/1974 | Fed. Rep. of Germany | 148/16.5 |
| 548457 | 4/1974 | Switzerland | 148/16.5 |

OTHER PUBLICATIONS

Metal Progress, "Drip Feed Carburizing", Nov. 1978, pp. 24–31.

*Primary Examiner*—Peter K. Skiff
*Attorney, Agent, or Firm*—Lee C. Robinson, Jr.

[57] ABSTRACT

The method of carburizing steel workpieces comprises loading workpieces to be carburized in a furnace and maintaining them in a carbon enriching atmosphere comprising carbon monoxide, hydrogen and nitrogen. The treatment comprises a first phase carried out at a temperature from 850° C. to 1050° C. followed by a second phase carried out at a temperature from 700° C. to 950° C. During the first phase an atmosphere is used having a carbon potential from about 1.1% to about 1.6% by weight and during the second phase the amount of nitrogen in the atmosphere is increased from two to thirty times so that the carbon potential for the second phase is at least about 0.5% by weight less than the carbon potential for the first phase.

19 Claims, 3 Drawing Figures

METHOD OF CARBURIZING WORKPIECE

BACKGROUND OF THE INVENTION

The present invention relates to a method of carburizing metal workpieces, in particular, of steel.

The use of carbon enriching atmospheres for carburizing steel at temperatures from 1050° C. to 800° C. is known to increase the amount of carbon in a case of a certain depth from the surface which increases the hardness and the wear resistance of the case.

The atmospheres used generally contain about 20% CO, 40% $H_2$ and 40% $N_2$ and very small amounts of $CO_2$ and water vapor. Such atmospheres are produced by generators known as endo gas generators or synthetically from gas or gasohol mixtures. The most common of these mixtures is methanol-nitrogen. Indeed, at the treatment temperatures used the methanol decomposes according to the reaction $CH_3OH \rightarrow CO + 2H_2$ and a gaseous mixture having the above composition may be obtained.

The carburizing method is carried out in the following manner: the carbon monoxide present in the atmosphere reacts according the reaction: $2CO \rightleftarrows CO_2 + C$ (1) and there is then a transfer of carbon atoms to the metal. The hydrogen present in the atmosphere also takes part in the carburization from the point of view of the speed of the process for it reacts with the carbon monoxide according to the reaction: $CO + H_2 \rightleftarrows C + H_2O$ (2).

Some carburizing treatments used up to the present, particularly those carried out in furnaces having a plurality of zones, comprise two successive phases: a first phase called the carburizing phase followed by a second phase called the diffusion phase. More specifically, such treatments comprise subjecting the workpiece to be treated in the carburizing zone to a temperature from 900° C. to 940° C. in a carbon enriched atmosphere having a carbon potential from 0.9% to 1.2% by weight for a certain period, then putting the workpiece into the diffusion zone where the process is allowed to proceed, the temperature decreasing gradually to between 880° C. and 800° C. and the carbon potential of the atmosphere decreasing to a value from 0.7 to 0.9% by weight. The workpiece is then quenched in a gaseous or liquid phase, e.g., an oil bath. The drop in temperature during the diffusion phase minimizes the problems of deformation during quenching.

The difficulties with such treatments are such that at the beginning of the process a high carbon potential is provided to increase the quantity of carbon without the carbon potential exceeding a limit beyond which soot is deposited on the workpiece. The limit, from 1% to 1.6% is a function of the temperature used. Also, at the end of the treatment it is advisable to have a lower carbon potential so as to diminish the amount of carbon on the surface, if not, during subsequent quenching the metallurgical properties of the workpiece are not satisfactory because there is then a residual austenitic phase present and therefore low surface hardness of workpiece. As has been seen, during carburizing treatments is posed the problem of providing and monitoring a predetermined carbon potential during each of the two phases of treatment.

According to the methods used up to now, to obtain the desired carbon potential during each of the phases in addition the mixture for forming CO, $H_2$ and $N_2$ constituents a hydrocarbon such as methane, propane or butane is injected in each of the zones and the flow rate of the hydrocarbon is regulated as a function of the amount of $CO_2$ in the atmosphere. Indeed, given the reaction by which the workpiece being treated consumes CO (see reaction (1)) and the air intake into the treatment chamber, the $CO_2$ concentration of the atmosphere has a tendency to increase and therefore the carbon potential tends to decrease. This is why the amount of $CO_2$ in the atmosphere is monitored and the injection flow rate of the hydrocarbon is regulated as a function of the sought carbon potential. This regulation may also be effected by monitoring the amount of $H_2O$ or $O_2$ in the atmosphere.

Since the advent of synthetic atmospheres namely of nitrogen and methanol, an increase in the amounts of CO and $H_2$ in the treatment atmospheres has been sought. In this respect particular reference should be made to the process disclosed in U.S. Pat. No. 4,306,918. This process comprises a first phase in which pure methanol is injected into the treatment furnace and the workpieces are maintained in an atmosphere having a carbon potential from 0.8% to 1.1%, then in a second phase injecting nitrogen (which is generally less expensive than methanol) into the furnace so the treatment is less expensive and maintaining the workpieces in an atmosphere having a carbon potential from 0.7% to 0.9%. This process provides great carburized case depths rather rapidly owing to the increase of the fuel constituents such as CO and $H_2$ during the first phase. It is observed that according to U.S. Pat. No. 4,306,918 the ranges of carbon potential of the atmospheres used are conventional ranges, i.e., 0.7% to 1.1% an in all cases less than 1.1%, and the difference of the carbon potential between the two phases is small (0.2%).

SUMMARY OF THE INVENTION

According to the present invention there is provided a method for carburizing metal workpieces to obtain case hardening and satisfactory carburized case depth in a shorter period of treatment.

According to one aspect of the invention there is provided a method of carburizing workpieces, in particular of steel, the method wherein workpieces to be carburized are loaded in a furnace and are maintained in a carbon enriching atmosphere containing carbon monoxide, hydrogen and nitrogen, a first phase of the treatment being carried out at a temperature from 850° C. to 1050° C. and a second phase of the treatment being carried out at a temperature from 700° C. to 950° C., (preferably 800° C. to 950° C.), the method comprising using an atmosphere for the first phase containing from about 20% to about 50% carbon monoxide by volume and from about 40% to about 75% hydrogen by volume and having a carbon potential of from about 1.1% to about 1.4% by weight (said carbon potential being very near the limit value which produces soot deposits), and increasing the amount of nitrogen in the atmosphere for the second phase from two to thirty times amount of nitrogen in the atmosphere for the first phase so that the carbon potential for the second phase is at least about 0.5% by weight less than the carbon potential for the first phase.

Preferably, the proportion of nitrogen in the atmosphere during the first phase is at least 1% and at most 40% by volume and the proportion of nitrogen in the atmosphere during the second phase is from about 30% to about 80% by volume.

As will be understood, to improve the productivity of carburization, the applicants have sought to increase the carbon potential during the first phase to accelerate the carbon enrichment of the workpiece.

Still, to obtain good metallurgical properties it is necessary to diminish the percentage of carbon near the surface. To do this the carbon potential of the atmosphere during the second phase must be reduced considerably. Yet it is difficult to make such a considerable and so sudden a change in the carbon potential by conventional means such as adjusting the rate of injection of the hydrocarbon into the furnace, and all the more so when the atmosphere is very rich in CO and $H_2$.

In view of the above remarks the applicants contemplated lowering the carbon potential during the second phase by diluting the atmosphere with an inert gas such as nitrogen.

Indeed, as shown by reaction (1), the carbon potential decreases with the ratio $(PCO)^2/(PCO_2)$. By diluting the atmosphere with nitrogen the partial pressures of CO and $CO_2$ are reduced in the same proportions; on the other hand, the ratio $(PCO)^2/(PCO_2)$ decreases and therefore the carbon potential decreases.

DETAILED DESCRIPTION

Figure 1:
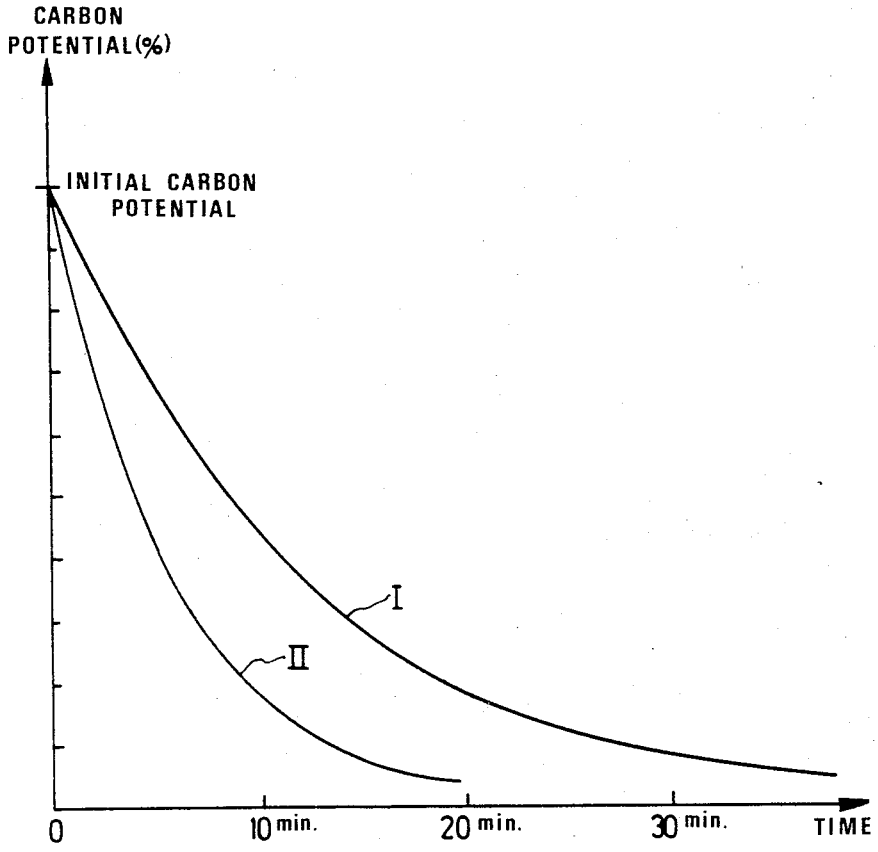
FIG. 1 is a graph of carbon potential in an ideal isothermal furnace.

The graph of accompanying FIG. 1 shows the theoretical change of the carbon potential in a furnace at constant temperature (without taking into account the influence or the fluid tightness of the furnace and the nature of its inner wall), under an initial atmosphere of CO, $H_2$ and $N_2$ when large amounts of nitrogen are injected into the furnace. This graph shows two curves (I) and (II) giving the carbon potential as a function of time for the ratios $(D/V)=5$ and $(D/V)=10$ respectively, D being the rate of nitrogen injected into the furnace in $m^3/hr$ and V the volume of the furnace in $m^3$. These curves show that the dilution of the carburizing atmosphere with nitrogen during the diffusion phase, such as developed by the applicants, enables the carbon potential to be diminished very rapidly.

Thus, owning to the method according to the invention, an atmosphere having a high carbon potential during the first phase may be used, even when employing an atmosphere rich in fuel constituents, and the carbon potential may be sufficiently diminished during the second phase.

According to a preferred mode of the invention the carburizing atmosphere is formed by introducing into the furnace a mixture of nitrogen and methanol (methanol being sprayed by the stream of gaseous nitrogen) in such proportions that the desired percentages of CO and $H_2$ are obtained. According to the invention the carburizing atmosphere may also be formed by introducing an endothermic gas into the furnace.

According to an alternative mode of the invention a gaseous hydrocarbon such as methane, propoane or butane is introduced in small proportions (from 0.5% to 5) with respect to the total amount of gaseous mixture introduced.

The method may be carried out in two different ways:

(1) Measuring during the treatment, i.e. the injection of the methanol-nitrogen mixture and of the hydrocarbon, the concentrations of CO and $CO_2$, or CO and $O_2$, or CO and $H_2O$, or $CO_2$ and $O_2$, of the atmosphere formed, and possibly the temperature, thereby permitting the carbon potential to be derived, and varying the rate of nitrogen injected into the furnace so as to obtain the desired carbon potential for each of the two phases.

(2) Determining through preliminary testings, taking into account the steel to be carburized, the dimensions of the furnace, etc . . . , the values of the nitrogen concentration that the atmosphere must have to obtain the desired values of carbon potential for each of the phases; then carrying out the carburization proper while injecting the methanol-nitrogen mixture during each of the two phases in such proportions that the concentrations of nitrogen thus determined are obtained and adjusting the carbon potential by regulating the rate of the hydrocarbon injected into the furnace.

Preferably, in addition, gaseous ammonia may be injected into the furnace in a proportion of 0.1% to 10% by volume with respect to the total gaseous mixture introduced, thereby providing carbonitriding. This variant provides additional case hardening of the treated workpieces. The amount of ammonia introduced into the furnace is selected as a function of the steel treated and the desired degree of nitriding.

Two examples of the present carburizing method are given which will bring out these and other features and advantages of the invention.

EXAMPLE 1

Figure 2:
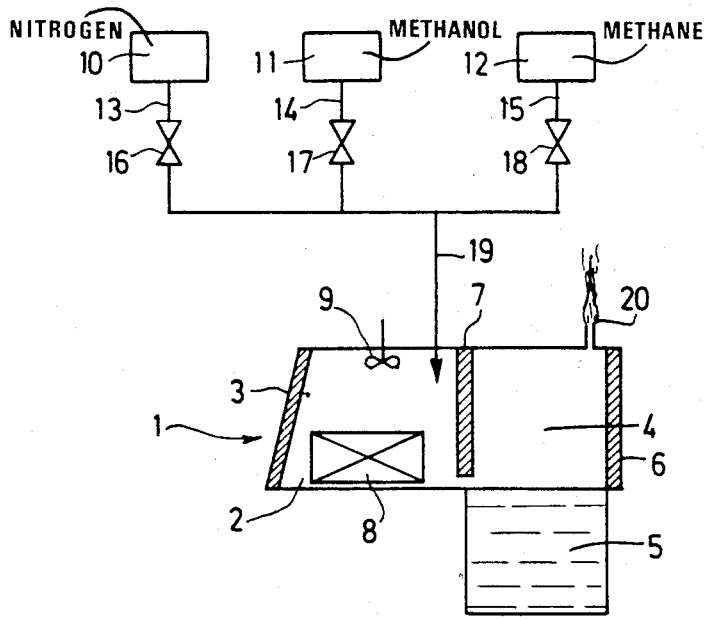
FIG. 2 is a schmatic diagram of one embodiment of a batch type furnace for carrying out the method of this invention.

The method is carried out on workpieces of 18CD4 steel in a batch type furnace, diagrammatically illustrated in FIG. 2.

The furnace 1 coprises a metal enclosure lined with a refractory material. It comprises a treatment zone 2 having a door 3 for charging workpieces and a vestibule 4 having an oil quenching bath and an exit door 6 for the carburized workpieces. The treatment zone 2 and vestibule 4 are separated by an interior door 7. The workpieces to be carburized are placed in a basket 8 supported on the bottom of the treatment zone 2. A fan 9 the function of which is to mix constantly the atmosphere in the furnace is positioned at a distance above the basket 8. Nitrogen, methanol and methane storage tanks 10, 11 and 12 are respectively connected by lines 13, 14 and 15 having valves 16, 17 and 18 to line 19 which opens into the upper part of the treatment zone 2. The gaseous effluent is vented by burning as a flare 20.

The furnace is heated to a temperature of 920° C. and then a methanol-nitrogen mixture is introduced in such proportions that the atmosphere formed in the furnace contains about 10% $N_2$, 30% CO and 60% $H_2$ as the main constituents. After a period of time workpieces are loaded in the treatement zone 2 allowing the temperature to rise to 920° C. and the carbon potential of the atmosphere to reach 1.3% and maintaining the workpieces in this atmosphere for 2 hours and 25 minutes. During this phase the amount of $CO_2$ in the atmosphere is 0.20%.

Then the second phase is carried out at 860° C., by increasing the amount of nitrogen injected into treatment zone 2 so that the atmosphere formed in the enclosure contains the following main constituents about 70% $N_2$, 10% CO and 20% $H_2$ and the carbon potential is 0.7%. The workpieces are maintained in this atmosphere for 45 minutes. During this phase the amount of $CO_2$ in the atmosphere is 0.095%.

During these two phases a small percentage of methane (0.5%–5% with respect to the total amount of the gaseous mixture introduced) is injected, and the injection flow rate of the methane is regulated to adjust the carbon potential to the predetermined value.

The considerable change of the carbon potential between the two phases may be obtained without any difficulty owing to the diluting effect of the nitrogen, the amount of $CO_2$ necessary for obtaining the desired carbon potentials logically varying in the diluting direction.

After quenching the carburized workpieces in the oil bath 5 the hardness of the carburized case is measured. The results obtained are as follows:

Vickers hardness at the surface: 890 VH

Depth of the case for a Vickers hardness of 550 VH: 0.86 mm.

COMPARATIVE TREATMENT FOR EXAMPLE 1

By way of comparison, carburization was carried out with an atmosphere rich in fuel constituents having exactly the same composisiton as that of the first phase of treatment described above in Example 1 but without modifying the injection of nitrogen during the second phase, that is to say, with a constant atmosphere. This comparative treatment was carried out in the same furnace on 18CD4 steel workpieces identical to those of Example 1. The first phase therefore is carried out at a temperature of 920° C. with an atmosphere whose concentration of main constituents is 10% $N_2$, 30% CO, and 60% $H_2$, with the injection of a small amount of methane and regulation of the injection flow rate of the methane to adjust the carbon potential to 1%. The amount of $CO_2$ in the atmosphere is 0.28%. The workpieces are maintained in the atmosphere for three hours. The second is then carried out at 860° C. in the same atmosphere as above for one hour, adjusting the carbon potential to 0.8%. The amount of $CO_2$ in the atmosphere is 0.72%.

According to this carburizing treatment an atmosphere having a carbon potential greater than 1% cannot be used during the first phase. Indeed, as the two phases are carried out in a constant atmosphere it is not possible to increase the amount of $CO_2$ enough to cause a decrease of the carbon potential in the second phase which is necessary to obtain a case having good metallurgical properties.

After quenching the workpieces thus treated in an oil bath the hardness of the carburized case is measured. The results obtained are as follows:

Vickers hardness at the surface: 887 VH

Depth of the case for a Vickers hardness of 550 VH: 0.85 mm.

It is therefore seen that owing to the present carburizing method the dilution of the atmosphere with nitrogen during the diffusion phase yields results as regards the carburized case, similar to those obtained with an atmosphere having a constant composition, rich in fuel constituents, but on the other hand the present carburizing method produces savings of 20% on the overall length of the treatment.

EXAMPLE 2

Figure 3:
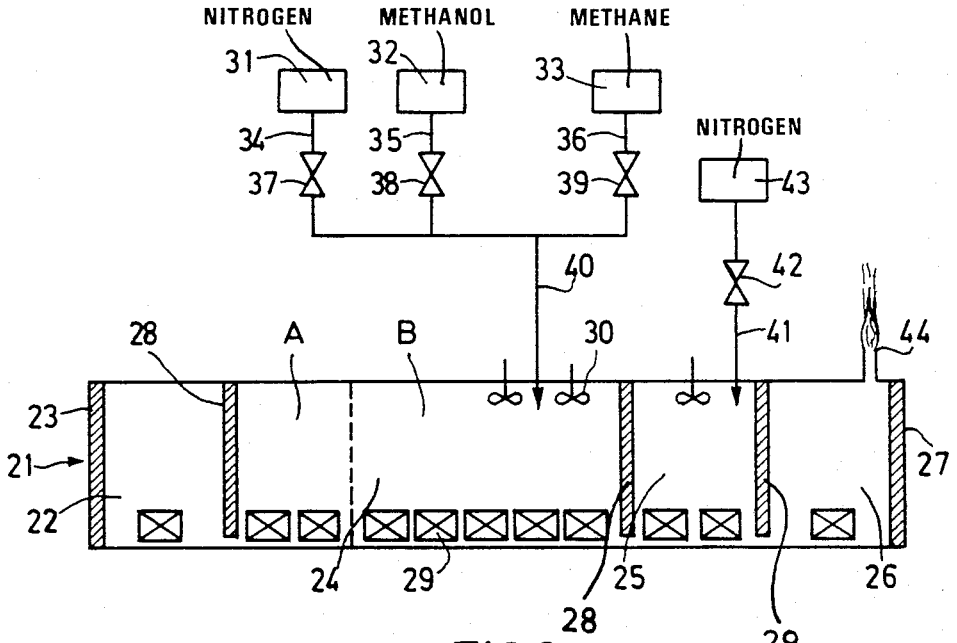
FIG. 3 is a schmatic diagram of one embodiment of a continuous type furnace for carrying out the method of this invention.

The carburizing method of the invention was carried out on 18CD2 steel workpieces in a forced circulation continuous furnaces diagrammatically illustrated in FIG. 3.

Furnace 21 comprises an entrance vestibule 22 having a charging door 23 for workpieces to be carburized, a carburizing zone 24, a diffusion zone 25 and an exit vestibule 26 having an exit door 27 for the carburized workpieces. The entrance vestibule 22, the carburizing zone 24, the diffusion zone 25 and the exit vestibule 26 are separated from one another by interior doors 28. The workpieces to be carburized are disposed in baskets 29 which are displaceable along the bottom of the furnace 21. The carburizing zone 24 comprises two parts A and B. In part A the workpieces are heated to the desired temperature and in part B carburizing proper is carried out. Fans 30 whose function is to constantly mix the atmosphere in the furnace are placed at a distance above the baskets 29 in part B of the carburizing zone 24 and in the diffusion zone 25. Nitrogen, methanol and methane tanks diagrammatically represented at 31, 32 and 33 respectively are connected via lines 34, 35 and 36 having valves 37, 38 and 39 to line 40 which opens into part B of the carburizing zone 24. A line 41 equipped with a valve 42 and connected to a nitrogen tank at 43 opens into the diffusion zone 25. The gaseous effluent is vented by burning as a flare 44. The carburized workpieces are then cooled in an oil bath (not shown in the drawing).

The temperature in the carburizing zone 24 is raised to 900° C. A methanol-nitrogen mixture is injected into this zone in such proportions that the atmosphere formed in the zone contains as main constituents about 10% $N_2$, 30% CO and 60% $H_2$ as well as a small amount of methane (0.5% to 5% with respect to the total amount of gaseous mixture introduced) so as to obtain an amount of $CO_2$ of 0.27% which corresponds to a carbon potential of 1.2%. Part B of the carburizing zone 24 may contain five baskets.

The diffusion zone 25 is at 860° C. Only nitrogen is injected into this zone (the fuel constituents such as CO and $H_2$ come directly from the carburizing zone) in such an amount that the atmosphere in the diffusion zone contains about 10% CO and 20% $H_2$. The proportion of $CO_2$ in the atmosphere is 0.115% which corresponds to a carbon potential of 0.6%. The diffusion zone 25 may contain two baskets.

The baskets containing the workpieces to be carburized are introduced into the furnace every 11 minutes and 15 seconds. The workpieces therefore remain 56 minutes and 15 seconds in the carburizing zone and 22 minutes and 30 seconds in the diffusion zone.

After quenching the carburized workpieces in an oil bath, hardness measurements of the carburized case yield the following results:

Vickers hardness at the surface: 925 VH

Depth of the case for a Vickers hardness of 550 VH: 0.45 mm.

COMPARATIVE TREATMENT FOR EXAMPLE 2

By way of comparison carburizing is carried out in an atmosphere rich in fuel constituents, of the same composition of $N_2$, CO and $H_2$ (10% $N_2$, 30% CO and 60% $H_2$) as the atmosphere used in the carburizing zone during the carburizing method of the Example 2 above;

yet in the comparative treatment the atmosphere is the same in the carburizing zone and the diffusion zone.

The carburized workpieces and the temperatures of the carburizing and diffusion zones are the same as in Example 2. On the other hand, the amount of $CO_2$ in the atmosphere is 0.37% in the carburizing zone which corresponds to a carbon potential of 0.9%, and the amount of $CO_2$ in the atmosphere in the diffusion zone is 0.85% which corresponds to a carbon potential of 0.7%. A greater difference of the amount of $CO_2$ in the two zones cannot be contemplated, therefore a higher carbon potential in the first zone, since there is no change in the overall atmosphere.

Under these conditions of carburization it is necessary to extend the time cycle. The baskets containing the workpieces to be carburized are introduced into the furnace every 15 minutes. The workpieces therefore remain one hour and 15 minutes in the carburizing zone and 30 minutes in the diffusion zone.

After the quenching of the thus carburized workpieces in an oil bath, the hardness or the carburized case is measured which measurements yield the following results:

Surface hardness of the case: 923 VH

Depth of the case for a Vickers hardness of 550 VH: 0.45 mm.

Thus, it will be seen that owing to the present carburizing method results are obtained which, as regards the metallurgical properties of the carburized workpieces, are similar to those obtained with a carburizing treatment in an atmosphere rich in fuel constitutents and the same in both zones of the furnace but, on the other hand, the present carburizing method produces savings of 25% on the overall length of the treatment.

What we claim is:

1. A method of carburizing metal workpieces, comprising the steps of:

loading workpieces to be carburized in a furnace;

maintaining the workpieces in a carbon enriching atmosphere containing carbon monoxide, hydrogen and nitrogen;

carrying out a first phase of the treatment at a first temperature from 850° to 1050° C.;

carrying out a second phase of the treatment directly thereafter at a second temperature, lower than said first temperature, from 700° C. to 950° C.;

using an atmosphere for the first phase containing at least 1% nitrogen, from about 20% to about 50% carbon monoxide by volume and from about 40% to about 75% hydrogen by volume and having a carbon potential of from about 1.1% to about 1.6% by weight; and increasing the amount of nitrogen in said atmosphere for carrying out the second phase from two to thirty times the amount of nitrogen in the atmosphere used for the first phase so that the carbon potential for the second phase remains significant, but is reduced at least 0.5% by weight below the carbon potential for the first phase, such that the length of the combined first and second phases is less than for a conventional carburizing treatment.

2. A method according to claim 1, wherein the proportion of nitrogen in the atmosphere during the first phase is at most 40% by volume and the proportion of nitrogen in the atmosphere during the second phase is from about 30% to about 80% by volume.

3. A method according to claim 1, wherein the carbon enriching atmosphere is formed by a mixture of methanol and nitrogen.

4. A method according to claim 3, further comprising injecting into the furnace a gaseous hydrocarbon selected from group consisting of methane, propane and butane in an amount of from 0.5% to 5% by volume with respect to the total atmosphere in the furnace.

5. A method according to claim 1, comprising measuring during the treatment the concentrations of CO and $CO_2$ in the atmosphere for determining the carbon potential and varying the amount of nitrogen injected into the furnace to obtain the desired values of the carbon potential for the first and second phases.

6. A method according to claim 1, comprising measuring during the treatment the concentrations of CO and $O_2$ in the atmosphere for determining the carbon potential and varying the amount of nitrogen injected into the furnace to obtain the desired values of the carbon potential for the first and second phases.

7. A method according to claim 1, comprising measuring during the treatment the concentrations of CO and $H_2O$ in the atmosphere for determining the carbon potential and varying the amount of nitrogen injected into the furnace to obtain the desired values of the carbon potential for the first and second phases.

8. A method according to claim 1, comprising measuring during the treatment the concentrations of $CO_2$ and $O_2$ in the atmosphere for determining the carbon potential, and varying the amount of nitrogen injected into the furnace to obtain the desired values of the carbon potential for the first and second phases.

9. A method according to claim 4, comprising carrying out preliminary tests to determine the amounts of nitrogen for obtaining the desired carbon potential for each of the first and second phases, carrying out the first and second phases of the treatment while injecting the mixture of methanol and nitrogen to obtain the predetermined amount of nitrogen, and regulating the flow rate of the gaseous hydrocarbon injected into the furnace to adjust the carbon potential.

10. A method according to claim 1, further comprising introducing gaseous ammonia into the furnace in an amount from 0.1% to 10% by volume with respect to the total atmosphere in the furnace in order to carbonitride the workpieces.

11. A method according to claim 1, wherein the carbon potential of said first phase is at least 1.2%.

12. A method according to claim 1, wherein the atmosphere for the first phase contains at least about 10% by volume of nitrogen.

13. A method according to claim 1, wherein said second temperature is from about 800° C. to 950° C.

14. A method according to claim 1, wherein the carbon potential for the first phase is adjusted by injecting a hydrogen gas in a finite amount less than 5% by volume.

15. A method according to claim 1, wherein said workpieces are steel.

16. A method of carburizing metal workpieces, comprising the steps of:

loading workpieces to be carburized into a furnace;

maintaining the workpieces in a carbon enriching atmosphere containing carbon monoxide, hydrogen and nitrogen;

carrying not a first phase of the treatment at a first temperature from 850° C. at 1050° C.;

carrying out a second phase of the treatment directly thereafter at a second temperature lower than said first temperature, from 800° C. to 950° C.;

using at atmosphere for the first phase containing a significant amount of nitrogen, from about 20% to about 50% carbon monoxide by volume and from about 40% to about 75% hydrogen by volume and having a carbon potential of from about 1.1% to about 1.6% by weight; and adding nitrogen to said atmosphere to increase the amount of nitrogen in said atmosphere for carrying out the second phase from two to thirty times the amount of nitrogen in the atmosphere for the first phase so that the carbon potential remains significant but is reduced by about 0.5% by weight below the carbon potential for the first phase.

17. A method according to claim 16, wherein said metal workpieces are steel.

18. A method according to claim 16, wherein the carbon potential of said first phase is at least 1.2%.

19. A method according to claim 16, wherein the atmosphere for the first phase contains at least about 10% by volume of nitrogen.

* * * * *

REEXAMINATION CERTIFICATE (804th)

United States Patent [19]

[11] B1 4,519,853

Kostelitz et al.

[45] Certificate Issued Dec. 29, 1987

[54] METHOD OF CARBURIZING WORKPIECE

[75] Inventors: Michel Kostelitz, Versailles; Philippe Queille, Viroflay, both of France

[73] Assignee: L'Air Liquide, Societe Anonyme Pour l'Etude et l'Exploitation des Procedes Georges Claude, Paris, France

Reexamination Request:
No. 90/000,974, Mar. 26, 1986

Reexamination Certificate for:

| | |
|---|---|
| Patent No.: | 4,519,853 |
| Issued: | May 28, 1985 |
| Appl. No.: | 496,934 |
| Filed: | May 23, 1983 |

[30] Foreign Application Priority Data

May 28, 1982 [FR] France ..... 82 09328

[51] Int. Cl.[4] ..... C23C 8/22
[52] U.S. Cl. ..... 148/16.5
[58] Field of Search ..... 148/16.5, 128

[56] References Cited

U.S. PATENT DOCUMENTS

| | | | |
|---|---|---|---|
| Re. 26,935 | 8/1970 | Cullen | 148/16.5 |
| 3,950,192 | 4/1976 | Golland et al. | 148/16.5 |
| 4,049,472 | 9/1977 | Arndt | 148/16 |
| 4,145,232 | 3/1979 | Solomon | 148/16.5 |
| 4,175,986 | 11/1979 | Ewalt et al. | 148/16.5 |
| 4,201,600 | 5/1980 | Luiten et al. | 148/16.5 |
| 4,306,918 | 12/1981 | Kaspersma et al. | 148/16.5 |

OTHER PUBLICATIONS

Metals Handbook Eighth Edition vol. 2, Heat Treating, Cleaning and Finishing (1964), pp. 67–114.

Optimisation Model of a Two Stage Boost/Diffusion Treatment, J. Paulossoglou, British Steel Corporation 1976.

The Diffusion of Carbon and the Carburization Process, J. Taylor, pp. 257–264, Journal of the Iron and Steel Institute, Mar. 1950.

A New Large-Capacity High-Performance Energy-Efficient Sealed-Quench Furnace, W. Beldman, H. Pfau, W. Gohring Heat Treating of Metals, pp. 43–48, 1982.2.

Gas Carburizing American Society for Metals 1964, pp. 61–79, 101–114.

Results of Gas Carburizing, A. Moszczynski, pp. 440–453, Proceeding of the 18th International Conference on Heat Treatment of Materials 6–8, May 1980.

Direct Atmosphere Separation and Control in Heat Treatment Furnace, W. Goehring and C. H. Luiten, pp. 454–465, Proceedings of the 18th International Conference on Heat Treatment of Materials 6–8, May 1980.

Application of Instrumentation to Achieve Precision Carburizing, N. K. Koebel, J. Heat Treating, vol. 1, N2 1979, pp. 23–29.

Productivity Increase in Pusher Furnaces Using UCAR Protective Atmospheres from Nitrogen and Methanol, S. Jansen, Westec 82, Los Angeles, California, Mar. 23, 1982.

Nitrogen-Based Controlled Atmosphere an Alternative to Endothermic Gas, Heat Treatment of Metals, Jan. 1976, pp. 15–18.

*Primary Examiner*—Christopher W. Brody

[57] ABSTRACT

The method of carburizing steel workpieces comprises loading workpieces to be carburized in a furnace and maintaining them in a carbon enriching atmosphere comprising carbon monoxide, hydrogen and nitrogen. The treatment comprises a first phase carried out at a temperature from 850° to 1050° C. followed by a second phase carried out at a temperature from 700° C. to 950° C. During the first phase an atmosphere is used having a carbon potential from about 1.1% to about 1.6% by weight and during the second phase the amount of nitrogen in the atmosphere is increased from two to thirty times so that the carbon potential for the second phase is at least about 0.5% by weight less than the carbon potential for the first phase.

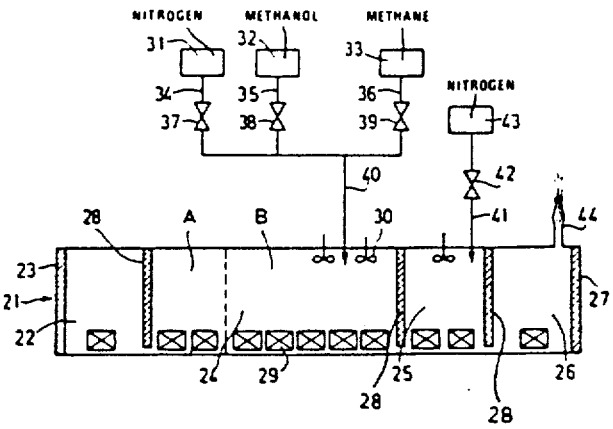

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 2, lines 14–35:

Since the advent of synthetic atmospheres namely of nitrogen and methanol, an increase in the amounts of CO and $H_2$ in the treatment atmospheres has been sought. In this respect particular reference should be made to the process disclosed in U.S. Pat. No. 4,306,918. This process comprises a first phase in which pure methanol is injected into the treatment furnace and the workpieces are maintained in an atmosphere having a carbon potential from 0.8% to 1.1%, then in a second phase injecting nitrogen (which is generally less expensive than methanol) into the furnace so the treatment is less expensive and maintaining the workpieces in an atmosphere having a *conventional* carbon potential [from 0.7% to 0.9%].

This process provides great carburized case depths rather rapidly owing to the increase of the fuel constituents such as CO and $H_2$ during the first phase. It is observed that according to U.S. Pat. No. 4,306,918 the ranges of carbon potential of the atmospheres used are conventional [ranges, i.e., 0.7% to 1.1% an in all cases less than 1.1%, and the difference of the carbon potential between the two phases is small (0.2%)].

AS A RESULT OF REEXAMINATION, IT HAS BEEN DETERMINED THAT:

The patentability of claims 1–13 and 15–19 is confirmed.

Claim 14 is determined to be patentable as amended.

14. A method according to claim 1, wherein the carbon potential for the first phase is adjusted by injecting a [hydrogen] *hydrocarbon* gas in a finite amount less than 5% by volume.

* * * * *